US009498074B1

(12) United States Patent
Baryshyan

(10) Patent No.: US 9,498,074 B1
(45) Date of Patent: Nov. 22, 2016

(54) PIZZA SLICE TRAY

(71) Applicant: FC Meyer Packaging LLC, Norwalk, CT (US)

(72) Inventor: Matthew Arthur Baryshyan, Stormville, NY (US)

(73) Assignee: FC Meyer Packaging LLC, Norwalk, CT (US)

( * ) Notice: Subject to any disclaimer, the term of this patent is extended or adjusted under 35 U.S.C. 154(b) by 0 days.

(21) Appl. No.: 14/850,622

(22) Filed: Sep. 10, 2015

(51) Int. Cl.

| | |
|---|---|
| ***B65D 81/36*** | (2006.01) |
| ***A47G 19/03*** | (2006.01) |
| ***A47G 21/00*** | (2006.01) |
| ***B65D 1/34*** | (2006.01) |
| ***B65D 65/42*** | (2006.01) |

(52) U.S. Cl.
CPC ..... *A47G 21/001* (2013.01); *A47G 19/03* (2013.01); *B65D 1/34* (2013.01); *B65D 65/42* (2013.01)

(58) Field of Classification Search
CPC ..... B65D 65/42; B65D 5/2014; B65D 5/2028; B65D 81/36; B65D 2585/366; A47G 19/03; A47G 21/001
USPC ..... 229/930
See application file for complete search history.

(56) References Cited

U.S. PATENT DOCUMENTS

| | | | | |
|---|---|---|---|---|
| 2,039,830 | A * | 5/1936 | Owens | A23G 9/503 229/101.1 |
| 4,798,323 | A * | 1/1989 | Platt | B65D 5/2057 229/115 |
| 5,632,379 | A * | 5/1997 | Frost | A47G 21/001 206/525 |
| 6,299,918 | B1 * | 10/2001 | Morgese | A47G 21/001 206/551 |
| 7,004,377 | B2 * | 2/2006 | Metcalf | A47G 21/001 229/101.1 |
| 7,102,111 | B2 * | 9/2006 | Metcalf | A47G 21/001 219/725 |
| 8,215,539 | B2 * | 7/2012 | Stonehouse | A47G 21/001 229/101 |
| 8,820,621 | B2 * | 9/2014 | Burke | A47G 21/001 229/146 |
| 2003/0006273 | A1 * | 1/2003 | Tsern | B65D 5/2014 229/115 |
| 2015/0265080 | A1 * | 9/2015 | Bagi | A47G 21/001 294/172 |

* cited by examiner

*Primary Examiner* — Gary Elkins
(74) *Attorney, Agent, or Firm* — Hess Patent Law Firm; Robert J. Hess

(57) ABSTRACT

A pizza slice tray made of paperboard with two inclining edges. Three scores are provided that extend between opposite ends and are creased to be folded. A central one of the scores separates the tray into symmetric halves. Each of the remaining two scores extend substantially parallel to respective ones of the inclining edges. A perforated line extends between the inclining edges to cross the three scores so as to separate from each other narrower and wider portions of the tray and enable folding at the perforated line so that the narrower portion lies under the wider portion.

14 Claims, 2 Drawing Sheets

PIZZA SLICE TRAY

BACKGROUND OF THE INVENTION

1. Field of the Invention

The invention relates to a die-cut, scored tray to serve an individual pizza slice in a manner that allow eating the pizza slice on the go.

2. Discussion of Related Art

Pizza Slice Servers

When purchased by the slice, pizza is either served in a small pizza box, on a paper plate, on a hinged tray or in a die cut pizza tray.

A small pizza box takes up more space than is needed to accommodate a single pizza slice since it would be sized for containing an individual-size pizza.

A paper plate is roundish and flimsy. Most pizza slices are triangular or rectangular is shape and thus the contour of the paper plate does not match the peripheral shape of the pizza slice.

A hinged tray takes up considerable space when opened and is difficult to eat out of because of its elongated hinge.

A die cut tray make for a good server of the pizza slice in the sense of being better than a paper plate since it is less flimsy and its shape better matches the contour of the pizza slice. However, the die cut tray does not function well when the pizza is eaten, especially when consumption is on the go.

Take-Out Packaging

Take-out packaging made from 100% recycled uncoated paperboard is excellent for use in large municipal markets.

100% Recycled Uncoated Paperboard

100% recycled uncoated paperboard is made from a high percentage content of post-consumer waste content paper, which may contain mixed paper, retired books, old magazines, newspaper and old corrugated boxes. The phrase "post-consumer waste" means that the fibre has been reclaimed from materials that have already passed through the consumer's hands. The result is a paperboard that is not coated on either side and is highly susceptible to grease absorption and staining, making the most sustainable, least expensive paperboard the least likely substrate to use for direct contact food packages for the following reasons:

1. Grease and water absorption into the paperboard
2. Inability to utilize the material for refrigerated products due to atmospheric moisture absorption into the paperboard.
3. Unsightly greasy fingerprints on the surface of the paperboard, giving a poor appearance.

To provide a surface that can withstand the absorption of atmospheric moisture and/or grease, the surface must be treated with a coating that seals in the surface of the paperboard. Such a coating may be a conventional barrier coating.

F.C. Meyer Packaging Meyercote Coating

F.C. Meyer Packaging has a website at http://www.fc-meyer,xin/sustainability.html The materials used in folding carton manufacture are described and there is a link to a demonstration video. It offers a grease resistant coating under the tradename MEYERKOTE that is available commercially to be applied to 100% recycled post consumer waste paperboard. The application of this grease resistance coating provides an oily surface texture with a glossy appearance (i.e., shiny and smooth) that effectively prevents absorption of grease into the paperboard thereby preventing stains.

Conventional Manufacture of a Paperboard Box

According to an article entitled FOLDING CARTONS, published online under the heading Packaging technology at http://packagingtech.net/56-fold ing-cartons.html?newsid=56:

Paperboard Selection

Successfully meeting the needs of a folding-carton user begins with choosing the paperboard best suited for the job. In general, this means selecting the grade with the lowest cost per unit area that is capable of satisfying the performance requirements of the specific application. Economics and performance dictate careful selection of paperboard grades for each use.

Selection Criteria

A variety of criteria are commonly used in the selection of paperboard grades. The Technical Association of the Pulp and Paper Industry (TAPPI) has published standardized test methods for many of these criteria (3) (see Testing, packaging materials). TAPPI Standard Methods are widely used and accepted by the industry. The most important and widely used criteria are shown below.

FDA/USDA Compliance.

This is a nondiscretionary criterion for food products and is dependent on the type of food and the type of contact anticipated between the food and the paperboard or coatings on the paperboard.

Color.

Color is typically chosen for marketing reasons. The side of the paperboard that becomes the outside of the carton is generally white, but the degree of whiteness varies among grades. Depending on the materials-selection and processing strategies of suppliers, outside board color can be blue-white or cream-white. These shades are noticeably different and can limit substitution of grades. Board color on the inside of cartons varies from white to gray to brown.

Physical Characteristics.

It is possible to establish minimum levels for each carton application that allow the package to satisfactorily withstand the rigors of packaging machinery, shipping, distribution, and use by the consumer. Physical properties commonly used to predict suitability of board for a given use include stiffness, tear strength, compressive strength, plybond strength, burst strength, tensile strength, elongation, and tensile energy absorption. Physical criteria normally define the basis weight and thickness of paperboard that is used to produce a carton.

Printing Characteristics.

Following the selection of a specific graphic design and printing method for the carton, a paperboard is selected based on these criteria: smoothness; coating strength; ink and varnish gloss; mottle resistance; and ink receptivity. Not all criteria are important for every printing technique.

Barrier.

The most common barrier requirements are for cartons to provide protection against moisture and grease. The choice of a barrier material and application method influences board choice. For example, if polyethylene (PE) is to be applied to the carton, a board with a treatment that holds the PE on the board surface can have economic and processing advantages over an untreated board. Materials and application methods are described below.

Paperboard Types

In the United States, the three most widely used types of paperboard are identified as follows:

Coated Solid Bleached Sulfate (SBS). 100% virgin, bleached, chemical furnish, clay-coated for printability.

Coated Solid Unbleached Sulfate (SUS). 100% virgin, unbleached, chemical furnish, clay-coated for printability.

Coated Recycled. Multiple layers of recycled fibers from a variety of sources, clay-coated for printability.

Coated recycled boards are the most widely used. Other types include folding box board (FBB) and white lined chipboard (WCC).

Overall treatments or coatings are applied to webs of paperboard to provide specific functions. Clay-based coatings to provide high-quality printing surfaces are the most common treatment applied on the paperboard machine. Grease-resistant fluorochemicals are applied on board machines as well, either as furnish additives, surface treatments, additives to clay coatings, or in combination. Mold-inhibiting chemicals are also applied to boards designed for bar-soap packaging, to prevent moisture in the product from initiating mold growth. Surface treatments applied on other-than-board production equipment are discussed below under Carton Manufacturing Processes.

Carton Manufacturing Processes

After a paperboard grade has been selected for a specific carton style and use, a variety of manufacturing options are available for converting that board into cartons. Although it is a highly unusual carton that requires each one of the steps or stages described below, all are commonly employed to produce folding cartons in today's market.

Extrusion Coating

This technique involves the coating of one or both sides of the paperboard web with a relatively thin (generally less than 0.001-in. (25.4-mm)) layer of a thermoplastic polymer (see Extrusion coating). Low-density polyethylene (LDPE) is the most commonly used extrusion coating for folding cartons and provides a cost-effective means of obtaining excellent protection against water resistance as well as a fairly good water-vapor barrier.

LDPE is also used as a heat sealant (see Sealing, heat), particularly when twoside coatings are employed. When the use temperature of the package exceeds 1501 F (651 C), HDPE or PP can be used to raise the acceptable use temperature to 2501 F (1211 C). These two polymers also provide improved grease resistance. Coating board with PET can raise the use temperature to over 4001 F (2041 C), suitable for most "dual-ovenable" applications. Coextrusion, in which backto-back layers of two plastics are laid onto paperboard, makes it possible to take advantage of the special properties of some exotic plastics, such as nylon, that by themselves will not adhere to paperboard.

Laminating

The earliest means of significantly enhancing the properties of paperboard was the combination with other materials through lamination (see Laminating). The most commonly used laminating adhesives are water-based glues (see Adhesives), or thermoplastic polymers. Materials laminated to paperboard include high-quality printing paper for enhanced graphics capabilities (see Paper), grease- or water-resistant paper for improved barrier, aluminum foil for barrier or aesthetics (see Foil, aluminum), and film (sometimes metallized) for barrier or aesthetics (see Metallizing).

Printing

Prior to the printing operation, paperboard is handled in web form. A decision must be made to continue in web form or convert the web to sheets before printing and die cutting. This choice is primarily dictated by the printing technique chosen (see Printing). Sheeting is most often done at the carton-producer's facility. A small segment of the industry purchases board sheeted at the paperboard mill.

The main processes for carton printing today are offset lithography, flexography, and gravure. Letterpress and silk screen are used to a limited extent. The most recently introduced process, digital printing, can be used for short print runs and for customizing packaging in already premade bulk. Printing involves solid print, text, illustrations, and diagrammatic representatios. Brand positioning can have a major influence on the printing design. Functional needs have to be taken in to account. Products that retain ink odors require special attention in choice of inks and printing methods. Products that are packed hot may need rub-resistant print surfaces.

Cutting and Creasing

Following the printing operation, individual cartons are cut from webs or large sheets and creased or scored along desired folding lines. Reciprocating flat-bed or platen cutting is almost invariably used to cut and crease sheets printed by offset lithography. In this technique, an accurately positioned array of steel cutting knives and scoring rules is pressed against a printed sheet of paperboard. The knives penetrate through the paperboard to cut out the pattern of the carton. Rules force the board to deform into channels in the counter plate, producing controlled lines of weakness (scores) along which the board will later predictably bend or fold. Alternatively, scores can be produced by cutting partially through the paperboard or by alternating uncut segments with completely cut-through segments.

Central Impression Flexographic Presses

Central impression flexographic presses are conventional. According to the online encyclopedia Wikipedia at https://en.wikipedia.org/wiki/Flexography:

Operational Overview

1. Fountain Roller

The fountain roller transfers the ink that is located in the ink pan to the second roller, which is the anilox roller. In Modern Flexo printing this is called a Meter or "metering" roller.

2. Anilox Roller

This is what makes flexography unique. The anilox roller meters the predetermined ink that is transferred for uniform thickness. It has engraved cells that carry a certain capacity of inks that can only be seen with a microscope. These rollers are responsible to transfer the inks to the flexible-plates that are already mounted on the Plate Cylinders.

3. Doctor Blade (Optional)

The doctor blade scrapes the anilox roll to ensure that the predetermined ink amount delivered is only what is contained within the engraved cells. Doctor blades have predominantly been made of steel but advanced doctor blades are now made of polymer materials, with several different types of beveled edges.

4. Plate Cylinder

The plate cylinder holds the printing plate, which is soft flexible rubber-like material. Tape, magnets, tension straps and/or ratchets hold the printing plate against the cylinder.

5. Impression Cylinder

The impression cylinder applies pressure to the plate cylinder, where the image is transferred to the substrate. This impression cylinder or "print Anvil" is required to apply pressure to the Plate Cylinder.

Presses

Stack Press

Color stations stack up vertically, which makes it easy to access. This press is able to print on both sides of the substrate.

Central Impression Press

All color stations are located in a circle around the impression cylinder. This press can only print on one side. Advantage: excellent registry In-Line Press Color stations are placed horizontally. This press prints on both sides, via a turnbar. Advantage: can print on heavier substrates, such as corrugated boards.

For maximum efficiency, the flexo presses produce large rolls of material that are then slit down to their finished size on slitting machines.

SUMMARY OF THE INVENTION

One aspect of the invention resides in a paper slice tray made of paperboard and having a scored face with a plurality of three scores including a central score and, on either side, a respective side score. The tray has opposite ends and two side edges that extend between the two opposite ends. Each side score is preferably extends substantially parallel to that of an associated one of the two side edges. One of the opposite ends of the tray may be narrower than that of the other end and thus the side edges, as well as the side scores, converge toward the narrower end. The central score in that case is non-parallel to the two side scores and essentially divides the tray into two symmetric halves.

A further aspect resides in a perforated line that extends across a full width of the tray between the side edges to cross each of the three scores and thereby device the tray into two adjoining regions. The tray may bend at the perforated line so that the two adjoining regions of the non-scored face are brought closer to each other. The scored face of the tray and the non-scored face of the tray each face away from each other.

Due to the grain of the paperboard and the perforations, the adjoining regions have a tendency to remain flexed with the perforated line bent due to perpendicular dynamic attributed to shear or tension arising from bending the scores from the scored face upward while bending the non-scored face downward at the perforated line.

Another aspect of the invention resides in a pizza slice tray made from 100% recycled paperboard, which is made from a high percentage content of post-consumer waste content paper, which may contain mixed paper, retired books, old magazines, newspaper and old corrugated boxes. The paperboard may or may not be coated on both sides, with one side having an oily surface texture and the other side having a slick, but non-oily surface texture with selected portions left uncoated and thus are dry to which is applied a water-based adhesive.

BRIEF DESCRIPTION OF THE DRAWING

For a better understanding of the present invention, reference is made to the following description and accompanying drawings, while the scope of the invention is set forth in the appended claims.

DETAILED DESCRIPTION OF THE INVENTION

Figure 1:
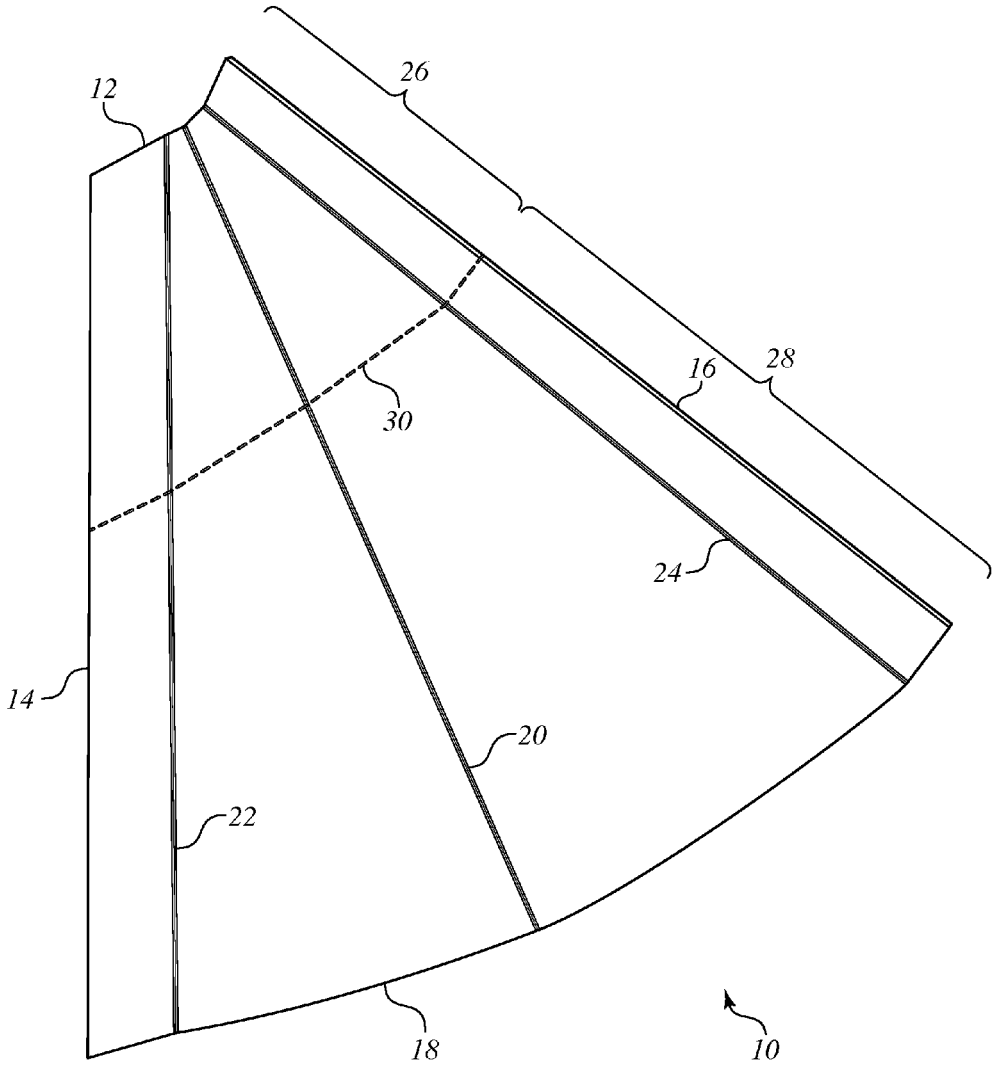
FIG. 1 is a top view of a pizza slice tray in accordance with the invention in a generally unfolded state.

The formation of a conventional folding carton is known, for instance, from an article entitled FOLDING CARTONS, published online under the heading Packaging technology at http://packagingtech.net/56-folding-cartons.html?newsid=56.

In accordance with the invention, the paperboard fibers that are used in the manufacture of paperboard are treated to kill off any lingering bacteria residing in them in a manner that is approved by the United States Food and Drug Administration (FDA) for use on a carton or packaging that is to contain food. Nevertheless, the paperboard is not resistant to staining even though its fibers may have been so treated. Such treatment does not prevent unsightly staining from arising when the paperboard is handled by one's greasy fingers as may occur during food packaging at a take-out establishment. This is because the hold-out, which is the resistance of fibers to fluid absorption, is not present for such fibers despite their treatment.

A grease resistance coating could be applied to the paperboard fibers themselves at the time of manufacture. Such a coating would improve the hold-out for such fibers. Even so, the present inventor has found that paperboard boxes made from such grease-resistant coated fibers still stain from greasy fingerprints.

In accordance with the invention, the pizza slice tray may be formed from the same blank formed as the lid of a conventional folding carton with the same equipment and materials. Indeed, multiple pizza slice trays may be formed from the lid of a conventional folding carton and its contour of each provided with perforations that enable removal of the pizza slice tray from the lid.

If desired, the pizza-supporting surface may be coated in a conventional manner such as with the MEYERCOTE grease-resistant coating that is petroleum based and thus will provide an oily surface texture with a glossy appearance. The opposite surface of the pizza slice tray may be coated in accordance with a water-based barrier coating with 35% to 45% solid suspension to have a slick surface texture that is not oily and a glazed appearance that has less light reflective shine than glossy. Such a water-based barrier coating is available in drums to the trade by requesting the water-based barrier coating under the tradename MEYERKOTE PLUS PASTRY COATING from Miami Valley Paper Company division of Mafcote Inc.

In order to apply the water-based coating, a two-station coating application with a conventional central impression flexographic printing press is used to coat the portions of the exterior facing surfaces. Each pass through the conventional central impression flexographic press entails passing the coated paperboard through a heated, forced air chamber that blooms the coating followed by letting the coating set on the surface of the paperboard without the heat and forced air being applied. The heating is to a temperature above that of room temperature, such as to 120 degrees Fahrenheit.

One station (of the conventional central impression flexographic printing press) carries a normal surfactant volume for the primer coat and another station carries ⅔ more in volume over that carried by the first station. During operation, the conventional central impression flexographic printing press first sizes the sheet of uncoated paperboard to be coated and applies the primer coat from one station. At another station, the primer coated paperboard is coated again with an overcoat that has a higher volume of the same coating material as the primer coat, such as ⅔ more volume. Afterward, the finished sheet goes through a heating process that sets both coating applications, which blooms out solids from the coating composition to create a tight surface tension and closes the sheet's surface to render it hydrophobic, thereby giving it the desired resistance to stain and thus protects against staining from greasy fingerprints.

To achieve blooming, chemical additives in the water-based coating are heated above room temperature such as at 120 degrees Fahrenheit to tighten the surface tension sufficient for surfactant sealing and to repel liquid—rendering the surface hydrophobic. Without such heat, no blooming occurs—the present inventor has found that such does not prevent stains from greasy fingerprints. Further, the present inventor found that after the primer coat is applied, the paperboard is still open in its ability to absorb moisture, which is why the higher volume overcoat needs to be provided as well to create the proper surface tension that seals the paperboard against absorbing fluid and thus rendering it resistant to staining from greasy fingerprints.

Unlike the case for uncoated paperboard, the water-based coated paperboard after blooming appears glazed in appearance on the surface and has a slick and smooth surface texture. The slick surface texture is not oily. The glazed appearance is not as shiny as the glossy appearance that results from a petroleum-based coating.

The end result is a product that is 100% recycled, 100% recyclable, 85% post-consumer waste content (PCW) and is 100% compostable within 90 days in a properly managed landfill.

As an alternative, the pizza slice tray may remain uncoated or coated on just one side (either the pizza supporting surface or the opposite surface).

Turning to the drawing, FIG. 1 shows a pizza slice tray 10 with two opposite faces—only the scored face is visible in FIG. 1, because the non-scored face is the underside. The scored face and the non-scored face are on opposite sides that face away from each other and are substantially flat, aside from the scores 20, 22, 24 on the scored face and the perforated line 30.

The pizza slice tray 10 preferably has a narrow end 12, left and right side edges 14, 16 and a convexly curved end 18 that forms an arc of a circle. The left and right side edges 14, 16 may be inclined to converge from the convexly curved end 18 to the narrow end 12 (or to diverge in the opposite direction form the narrow end 12 to the convexly curve end 18). As a result, the tray narrows while approaching the narrow end 12 from the convexly curved end 18 and widens while approaching the convexly curved end 18 from the narrow end 12.

There is a plurality of scores that extend the full length of the pizza slice tray 10 from the narrow end 12 to the curved end 18. The plurality of scored include a central score 20, a left side score 22, and a right side score 24. The three scores 20, 22, 24 extend as respective radii of the same circle as that defined by the arc formed by the convexly curved end. The three scores 20, 22, 24 are creased so as to be folded upward from the generally unfolded or slightly folded position of FIG. 1 and into the more folded position of FIG. 2.

The central score 20 is located to extend along the center of the pizza slice tray 10. The left and right scores 22, 24 run substantially parallel to respective left and right side edges 14, 16. Although the left and right scores 22, 24 each start out being closer to the central score 20 at the narrow end 12 than to the side edge 14, 16 that they run parallel with, they end up being closer to the respective side edge 14, 16 that they run parallel with at the curved end 18 than they are to the central score 20. The central score 20 is substantially equidistant between the left and right scores 22, 24 although non-parallel to both if the left and right scores 22, 24 converge.

There is also a series of perforations that are substantially parallel to the narrow end 12 to define a perforated line 30. The perforated line 30 is located closer to the narrow end 12 than to the convexly curved end 18, but closer to the middle of the pizza slice tray 10 than to the narrow end 12. The perforated line 30 in effect separates a narrower region 26 of the tray 10 from a wider region 28 of the tray 10.

Figure 2:
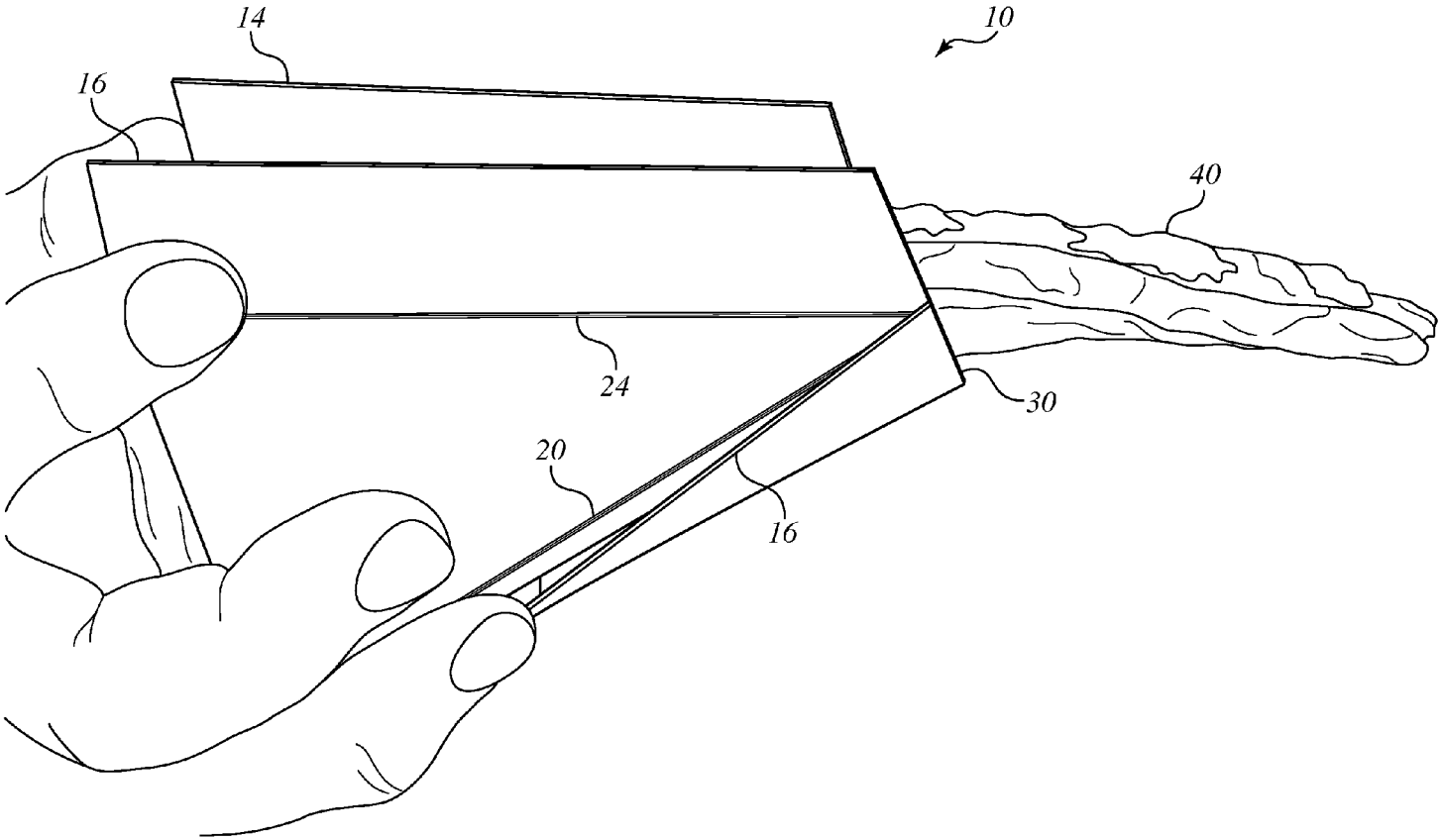
FIG. 2 is an isometric view of the pizza slice tray of FIG. 1 in a generally folded state holding a pizza slice in which the pizza slice has a triangular contour.

Turning to FIG. 2, the pizza slice tray 10 is shown with the scored face contacting the pizza slice and its non-scored face being held in a person's hand.

The perforated line 30 is bent in manner to make a dead fold down so that the pizza slice 40 may be eaten while holding the pizza slice tray 10 in the manner of FIG. 2 and holds itself under the tray 10, which may be attributed to perpendicular dynamic of the paperboard grain and the perforation. The perpendicular dynamic refers to a flexed condition that arises from bending the scores 20, 22, 24 lengthwise to fold upward while bending the perforated line 30 widthwise to fold downward at the same time. It may be attributed to shear, or strain produced by pressure, that creates tension in the paperboard that tends to keep the bent paperboard flexed since the direction of the scored fold and the perforated line fold is perpendicular to each other.

Portions of the perforated line 30 may be severed such as perforations that are between the side scores 22, 24 and their associated side edges 14, 16 so that the side strips are freed to support the pizza slice 40 in a sturdy manner. The narrower region 26 of the tray 10 is thus folded beneath the wider region 28 of the tray 10.

The narrower region 26 and the wider region 28 are adjoining regions of the non-scored face that are flexed into a flexed condition so that the adjoining regions are closer to each other than they were in their flattened condition prior to bending. The flex caused from a combination of the scores 20, 22, 24 being bent up from the scored face and the perforated line 30 being bent down from the non-scored face creates a flexed condition that tends to keep the adjoining regions (narrower region 26 and wider region 38) in the flexed condition, i.e., keeping the perforated line in its bent condition so that it does not unbend on it own.

The left and right scores 22, 24 define side portions (bounded between the left and right scores 22, 24 and the left and right side edges 14, 16) that are sufficiently sturdy to hold the pizza securely when held and folded. The center score 20 is ideal for eaters of pizza slices who like to fold their pizza slices for eating.

While the preferred shape of the pizza slice tray is depicted in the drawing, the shape may be changed without departing from the scope of the invention. For instance, the contour of the narrow end 12 may instead have curvature (concave or convex). zigzag or be triangular or have a mixture of those shapes. The contour of the convexly curved end 18 could instead be concavely curved or straight or triangular or zigzag or have a mixture of those shapes. The left and right inclining edges 14, 16 that are non-parallel to each other as depicted may instead be formed parallel to each other such as for holding a rectangular cut pizza slice.

While the foregoing description and drawings represent the preferred embodiments of the present invention, it will be understood that various changes and modifications may be made without departing from the scope of the present invention.

What is claimed is:

1. A pizza slice tray, comprising:

a tray having two opposite ends and two side edges, the tray having a scored face bounded by the two opposite ends and the two side edges and having a non-scored face bounded by the two opposite ends and the two side edges, the scored face and the non-scored face being opposite faces that face away from each other;

a plurality of scores on the scored face that extend between the two opposite ends of the tray to divide the scored face into a plurality of neighboring regions in succession, the plurality of scores including a central score and two side scores, the central score being spaced between the two side scores and dividing the tray into two substantially symmetric halves, each of the scores being bendable from an unbent position into a bent position so that the neighboring regions become closer to each other than in the unbent position;

a perforated line of successive perforations, the perforated line extending across the tray between the two side tray edges to cross each of the scores, the perforated line dividing the non-scored face into two adjoining regions, the perforated line being bendable from a flattened position into a bent position so that the two adjoining regions of the non-scored face become closer together than in the flattened position; and wherein the tray is formed to flex the adjoining regions into a flexed condition under tension in response to a combination of each of the scores being bent in a manner that brings each of the neighboring regions closer to each other than in the unbent position and to the perforated line being bent in a manner that brings the non-scored face of each of the adjoining regions closer to each other than in the flattened position, the adjoining regions having a tendency to remain in the flexed condition under tension in response to the combination.

2. The pizza slice tray of claim 1, wherein one of the opposite ends of the tray has a convex curvature of an arc of a circle, each of the scores extending along respective radii of the circle.

3. The pizza slice tray of claim 1, wherein the one of the two opposite ends is narrower than a remaining of the two opposite ends, the two side edges as well as the two side scores converging toward the one of the two opposite ends that is narrower than the remaining one of the two opposite ends.

4. The pizza slice tray of claim 3, wherein the two opposite ends space apart the two side edges from each other where the two side edges terminate.

5. The pizza slice tray of claim 3, wherein the two side edges are straight inclines, one of the two side scores being substantially parallel to one of the two side edges and a remaining one of the two side scores being substantially parallel to a remaining one of the two side edges.

6. A pizza slice tray, comprising:

a tray having two opposite ends and two side edges, the tray having a scored face bounded by the two opposite ends and the two side edges and having a non-scored face bounded by the two opposite ends and the two side edges, the scored face and the non-scored face being opposite faces that face away from each other;

a plurality of scores on the scored face that extend between the two opposite ends of the tray to divide the scored face into a plurality of neighboring regions in succession, the plurality of scores including a central score and two side scores, the central score being spaced between the two side scores and dividing the tray into two substantially symmetric halves, each of the scores being bendable from an unbent position into a bent position so that the neighboring regions become closer to each other than in the unbent position;

a perforated line of successive perforations that includes a severed portion between one of the edges and one of the two side scores and another severed portion between another of the edges and a remaining one of the two side scores and a remaining portion that includes uncut intermediate portions between neighboring ones of the successive perforations, the remaining portion of the perforated line extending across the tray between the two side scores to cross the central score, the remaining portion of the perforated line dividing the non-scored face into two adjoining regions, the remaining portion of the perforated line being bendable from a flattened position into a bent position so that the two adjoining regions of the non-scored face become closer together than in the flattened position; and wherein the tray is formed to flex the adjoining regions into a flexed condition under tension in response to a combination of each of the scores being bent in a manner that brings each of the neighboring regions closer to each other than in the unbent position and to the perforated line being bent in a manner that brings the non-scored face of each of the adjoining regions closer to each other than in the flattened position, the adjoining regions having a tendency to remain in the flexed condition under tension in response to the combination.

7. The pizza slice tray of claim 1, wherein the adjoining regions are in the flexed condition under tension.

8. The pizza slice tray of claim 1, wherein one of the opposite ends of the tray is wider than a remaining one of the opposite ends and has a convex curvature of an arc of a circle, each of the scores extending along respective radii of the circle, the two side edges converging from the one of the opposite ends that is wider than the remaining one of the opposite ends toward the remaining one of the opposite ends, the remaining one of the opposite ends having a distance that separates the two side edges from each other where the two side edges terminate.

9. The pizza slice tray of claim 8, wherein the tray is made of paperboard having a grain, further comprising:

anti-staining coating on the paperboard for preventing staining from contact with grease and water on the paperboard, the adjoining regions holding themselves in position relative to each other with the perforated line in the bent position because of a perpendicular dynamic of the grain of the paperboard and the perforations of the perforated line.

10. The pizza slice tray of claim 1, wherein the tray is made of paperboard, further comprising:

anti-staining coating on the paperboard for preventing staining from contact with grease and water on the paperboard.

11. The container of claim 10, wherein the anti-staining coating includes a water-based coating having a primer coat layer and an overcoat layer that is on the primer coat layer, the overcoat layer having a higher volume of a same coating material as that of the primer coat layer.

12. The pizza slice tray of claim 10, wherein the anti-staining coating includes a petroleum-based coating that provides an oily surface texture and a glossy appearance.

13. The pizza slice tray of claim 1, wherein the tray is made of paperboard, the paperboard has post-consumer waste content paper selected from the group consisting of mixed paper, retired books, magazines, newspaper, corrugated boxes, and any combination thereof.

14. The pizza slice tray of claim 1, wherein the tray is made of paperboard, the paperboard having treated fibers with sufficient potency at time of treatment to kill off bacteria residing in the fibers.

* * * * *